US005317855A

United States Patent [19]

De Leeuw

[11] Patent Number: 5,317,855

[45] Date of Patent: Jun. 7, 1994

[54] SUPPORTING ELEMENT TO BE USED IN BUILDING CONSTRUCTIONS

[76] Inventor: Petrus J. L. De Leeuw, B. van Heesselstraat 5, P.O. Box 58 5735 ZH, Aarle-Rixtel

[21] Appl. No.: 930,538

[22] PCT Filed: Jan. 27, 1992

[86] PCT No.: PCT/NL92/00019

§ 371 Date: Sep. 24, 1992

§ 102(e) Date: Sep. 24, 1992

[87] PCT Pub. No.: WO92/13156

PCT Pub. Date: Aug. 6, 1992

[30] Foreign Application Priority Data

Jan. 28, 1992 [NL] Netherlands ..... 9100139

[51] Int. Cl.[5] ..... E04H 12/00

[52] U.S. Cl. ..... 52/638; 248/235; 248/354.3

[58] Field of Search ..... 248/243, 235, 354.1, 248/354.3; 52/637, 638; 108/107; 212/269; 182/179; 211/192; 403/49

[56] References Cited

U.S. PATENT DOCUMENTS

| | | | |
|---|---|---|---|
| 4,030,612 | 6/1977 | Gray | 108/107 X |
| 4,101,231 | 7/1978 | Streib | 211/192 X |
| 4,369,859 | 1/1983 | Smits | 403/49 X |
| 4,439,052 | 3/1984 | Wallther | 211/192 X |
| 4,481,748 | 11/1984 | D'Alessio | 182/179 X |
| 4,587,786 | 5/1986 | Woods | 52/638 |
| 4,595,077 | 6/1986 | Buttgereit | 403/49 X |
| 5,028,164 | 7/1991 | Williams | 403/49 X |
| 5,078,532 | 1/1992 | Williams | 403/49 X |

FOREIGN PATENT DOCUMENTS

| | | | |
|---|---|---|---|
| 2002090 | 1/1970 | Fed. Rep. of Germany | 212/269 |
| 2502132 | 9/1982 | France | 212/269 |

*Primary Examiner*—J. Franklin Foss
*Attorney, Agent, or Firm*—David P. Gordon

[57] ABSTRACT

Supporting element for building constructions, comprising an outer tube (3) made of sheet steel, in which an inner tube (1) can be telescoped, the outer tube having ridges (13) intentionally provided by way of deformation and constituting a guide for the inner tube (1). As a result, lateral damages such as dents caused during construction operations may be absorbed by the wider portions of the outer tube (3) without impeding the telescopic capability of the inner tube (1). For coupling this element, a ring (23) is welded to the outer tube (3) which ring has a widened portion (31) at the location of each ridge (13), so that between the tube and the ring a cavity (33) is created which may accommodate the hooked end (35) of a coupling element (37). This end can be locked in that cavity by means of a lever (39) clamped with its end portion (54) against the bottom of the ring (23) by way of a displacing mechanism (41).

19 Claims, 6 Drawing Sheets

FIG. 9
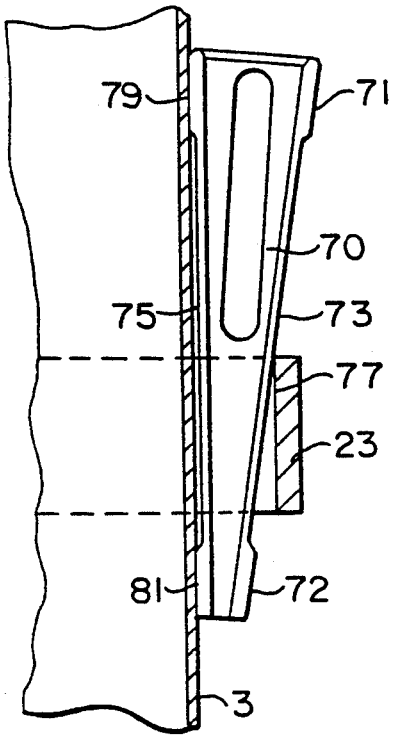
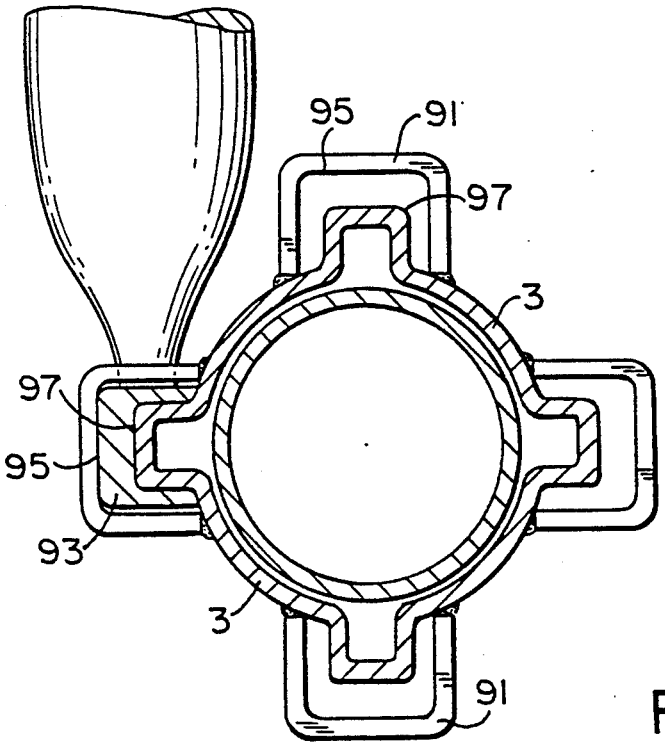
FIG. 10

SUPPORTING ELEMENT TO BE USED IN BUILDING CONSTRUCTIONS

BACKGROUND OF THE INVENTION

The invention relates to a supporting element to be used in building constructions, comprising a metal inner tube telescoping in a metal outer tube.

An element of this type is generally known and is used for various purposes in concrete construction works, for example, for vertically supporting forms for casting concrete floors, for erecting scaffoldings, or for providing support in a horizontal plane between, for example, two vertical walls.

The known constructions made of aluminium are formed by a set of telescopingly extending metal tubes having clearance, whose ends may comprise a fixed or hingeable foot or head plate and which tubes may further include means for not permitting the tubes to depart from each other. So-called adjustable and shoring struts and also standards for so-called frames in scaffoldings, as well as telescopic tube constructions for supporting vertical walls are generally known examples of said supporting elements.

In the known constructions for temporary support, preferably free adjustable struts, that is to say, without the need for much time-consuming header and shoring ties, are utilized to save time during forming and dismantling. The load-bearing capacity of a thus loaded adjustable strut is thus determined by the failure load as a result of the buckling of the adjustable strut, and which failure load is especially determined by the ratio of buckling length to the moment of inertia of the tubes. Because adjustable struts are normally to be installed and removed manually, in the known construction it is pursued to manufacture a lightest possible adjustable strut which possesses maximum loadability. For the known supporting elements a round tube is selected for this purpose, which tube has a maximum diameter and a small wall thickness, so that a tube construction is obtained having a maximum moment of inertia in all directions.

However, a relatively small wall thickness has appeared not to be capable of withstanding rough handling on the building site. Dents thus developed impede the telescopic operation of the inner tube relative to the outer tube. These deformations of the outer tube are usually caused by struts falling over or falling on top of each other when placed in the appropriate transport containers. Especially the protruding foot and head plates cause locally sharp dents during this operation. As a result, the telescopic operation of the tubes is rendered more difficult, if not completely impossible. In order to obtain a favourable load-bearing capacity of the construction, it is important that there be minimum clearance between the outer and inner tubes, but minor deformations of the outer tube may already terminate the telescopic operation of the tubes. Furthermore, generally as a safety precaution, the end of the inner tube sliding in the outer tube has a protuberance that is incapable of passing through the hole at the top of the outer tube, so that the inner tube is withheld from completely sliding out of the outer tube. A relatively large tube diameter further has the disadvantage that such constructions are hard to handle by hand.

SUMMARY OF THE INVENTION

It is an object of the invention to meet this objection by means of a construction, characterized in that the outer tube exhibits a round cross section and comprises recesses caused by deformation at least on three peripheral locations, these recesses providing guides for the inner tube along their surfaces facing the inner tube.

These recesses are specifically formed as ridges running in axial direction of the tube. More specifically, the ridges producing ribs on the outer periphery of the tube, provide that these ribs can absorb damage during work on the building site without the telescopic capability being reduced. In addition, thickenings preventing the inner tube from inadvertently departing from the outer tube may be provided on the inner tube between the ridges, which thickenings, in contradistinction to the prior-art constructions, may be amply dimensioned, whereas still sufficient clearance remains so that minor dents do not impede the telescopic capability of the construction. The ridges are furthermore advantageous in that an outer tube having a relatively large diameter can easily be taken by hand.

Preferably at least the outer tube is formed of sheet steel. Vis-a-vis the aluminium used in the prior-art telescopic tubes, the choice of sheet steel is advantageous in that a favourable weight-to-load capacity ratio may be achieved at a considerably lower cost price. This is due to the favourable values for the modulus of elasticity and also the failure limit of steel. Especially the lower modulus of elasticity of aluminium has the disadvantage that a larger compensatory wall thickness is to be chosen for isolated buckling poles, so that for equal diameters no weight advantage can be obtained when aluminium is used in lieu of steel.

According to a preferred embodiment of the invention, the ridge surface guiding the inner tube, seen in tangential direction of the tube section, is formed by about half the outer tube periphery.

The invention further provides a supporting element, characterized in that the outer tube accommodates at least one bracket which comprises a widened portion at the position of at least one ridge of the outer tube, the cavity between the outside wall of the outer tube and the bracket being accessible to the hooked part of a coupling element whose longitudinal axis is in essence perpendicular to that of the tube. This bracket is preferably shaped in such a way that it forms a widened part of a ring which ring is attached to the outer tube.

If such a ring having locally widened parts and to be considered a coupling ring were attached around a circularly cylindrical outside of the outer tube, this would rather rapidly lead to a larger diameter of that ring with all its inherent drawbacks. However, by positioning the ridges of the outer tube opposite to the protuberances of the ring, without an essential enlargement of the ring diameter being necessary, a favourable hooking facility is provided for the hooked part of a coupling element which can be attached perpendicularly to the tubes.

The hooked portion of the coupling element which may form part of, for example, a girder, may now also extend into the outer tube ridges as a result of which it becomes virtually impossible to push a hooked-on unattached girder out of the hooked position inadvertently. This provides a safer construction during the mounting phase.

For locking the coupling element, the invention further provides a first solution, characterized in that the coupling element may be clamped to the wall portion by means of a clamping device applied to the wall portion at a location diametral relative to the butting location of the hooked end of the coupling element, the forces originating from the coupling elements being transferred to the outer tube by way of the ring.

For locking the coupling element, the invention further provides a second solution, characterized in that the coupling element comprises a hooked wedge-shaped portion resting with the wedge flank portion located between the thicker wedge portion and the thinner wedge portion of the one wedge flank against the inside of the ring, and resting with the portions of the other wedge flank which are located above and below the ring against the outside of the outer tube. This solution provides the possibility of tangentially coupling rods and the like to the tubes, so that a header tie between vertical tubes may simply be realised, for example, for reducing the buckling length of the vertical tubes, in addition, this solution provides a fixed-angle connection in the vertical plane because of the butting of the wedge-shaped part against the outer tube in said cavity in the ring, so that it is possible to realise a stable construction by means of a single tangential coupling tube.

In order not to have the bottom of the ridge damaged and the telescopic capability of the inner tube adversely affected, the invention furthermore provides with the second solution that the sections of the wedge flank portions facing the tube rest against the ridge edges between the countersunk ridge portion and the adjacent wider outside of the outer tube, while leaving the countersunk ridge portion of the outer tube free. It should further be observed that it is alternatively possible to effect the clamping of the hooked element opposite to a bulge in the outside wall of the outer tube, this in contrast with the construction in which the appropriate ring portion is located opposite to a ridge in the outer tube.

The invention will now be briefly explained with reference to an embodiment shown in the drawings.

BRIEF DESCRIPTION OF THE DRAWINGS

FIG. 9 is a cross-sectional view along X—X of FIG. 8; and

FIG. 10 is a cross-sectional view of a variant of the coupling cavity.

DETAILED DESCRIPTION OF THE PREFERRED EMBODIMENT

Figure 1:
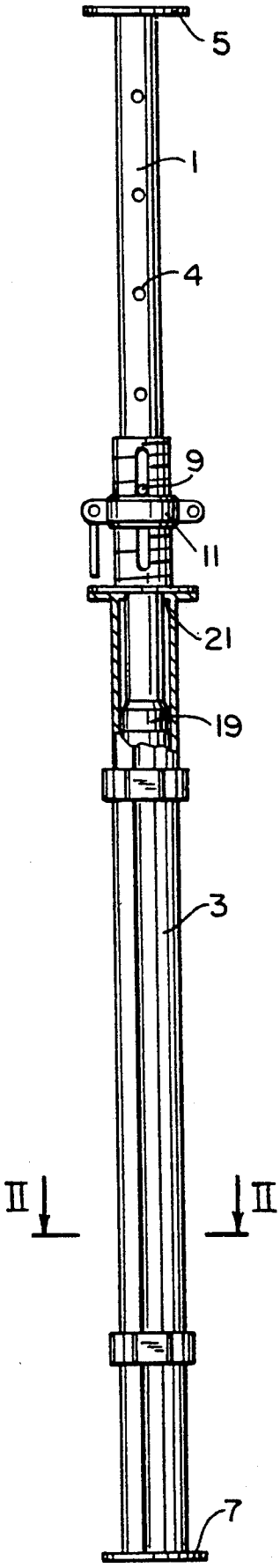
FIG. 1 shows an adjustable strut in vertical section and partly in longitudinal section.
Figure 2:
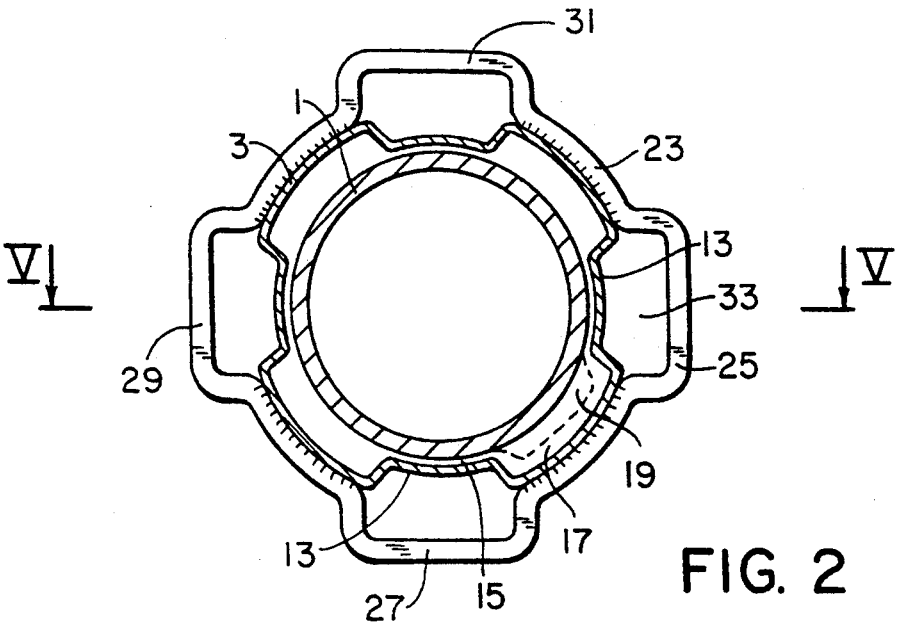
FIG. 2 is a cross-sectional view along II—II of FIG. 1.

The adjustable strut as shown in FIG. 1 comprises an inner tube which is slidable in an outer tube 3. The inner and outer tubes comprise a head and a foot plate 5, 7 respectively. The inner tube 1 has regularly interspaced holes 4. With the aid of pin 9, resting on the nut 11, a coarse adjustment of the strut can be obtained, after which the fine adjustment is effected by turning the nut 11. The outer tube 3 has four longitudinally running recesses 13, further denoted ridges, obtained by ridging a round tube, which on the inside form guiding faces 15 for the inner tube 1 sliding in the outer tube 3 (FIG. 2).

Between the ridges 13 there are axially running spaces 17. The inner tube 1 has at its end inside the outer tube one or more protuberances 19, which cannot pass the constriction 21 and thus prevent the inner tube from inadvertently sliding completely out of the outer tube 3. It will be evident that a thus formed outer tube is better capable of withstanding minor damaging because the wall is strengthened by the ridges. Any dents to the outside have no influence on the telescopic capability; they do not extend or stretch as far as the guiding faces 15. Since the clearance between outer tube 3 and protuberances 19 may be amply dimensioned, minor damages have little adverse effect here too. For that matter, these protuberances 19 are located in the space 17 between the ridges 13.

Figure 3:
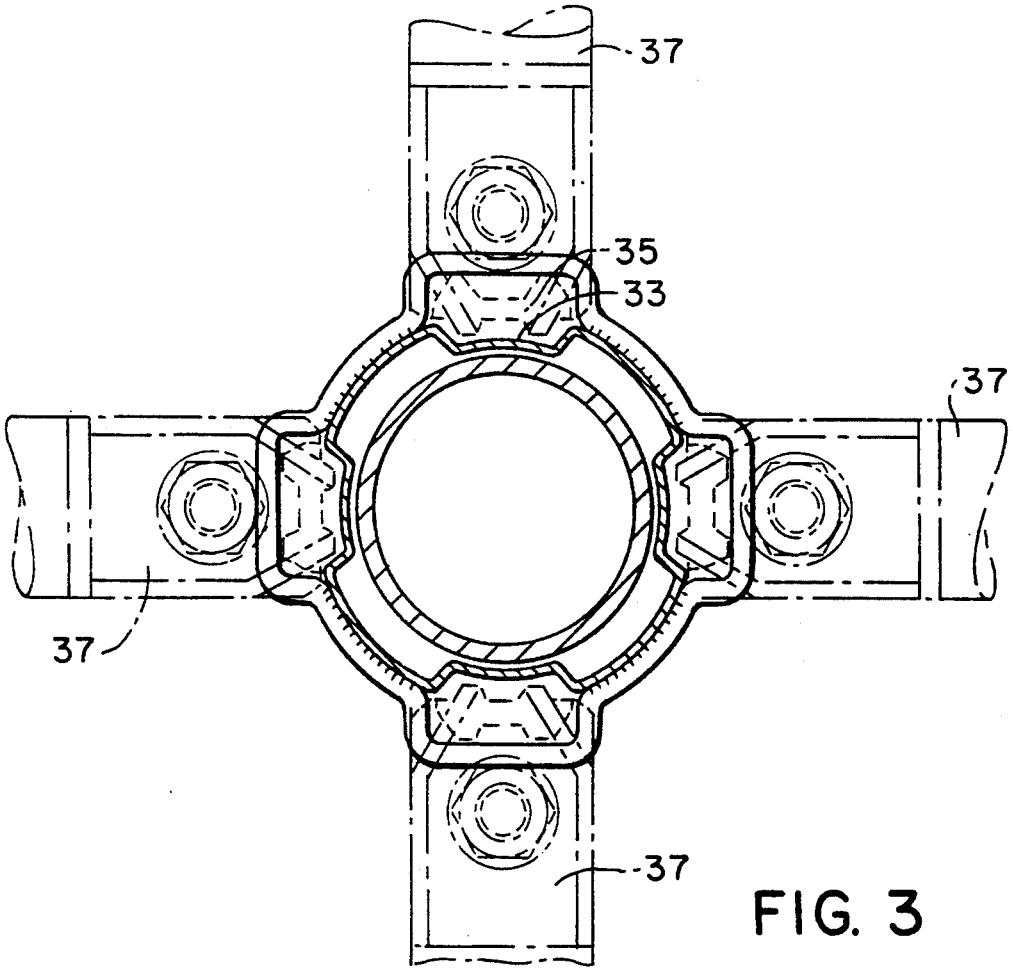
FIG. 3 shows a top view in which four coupling elements are attached to the telescopic construction as shown in FIG. 1.
Figure 4:
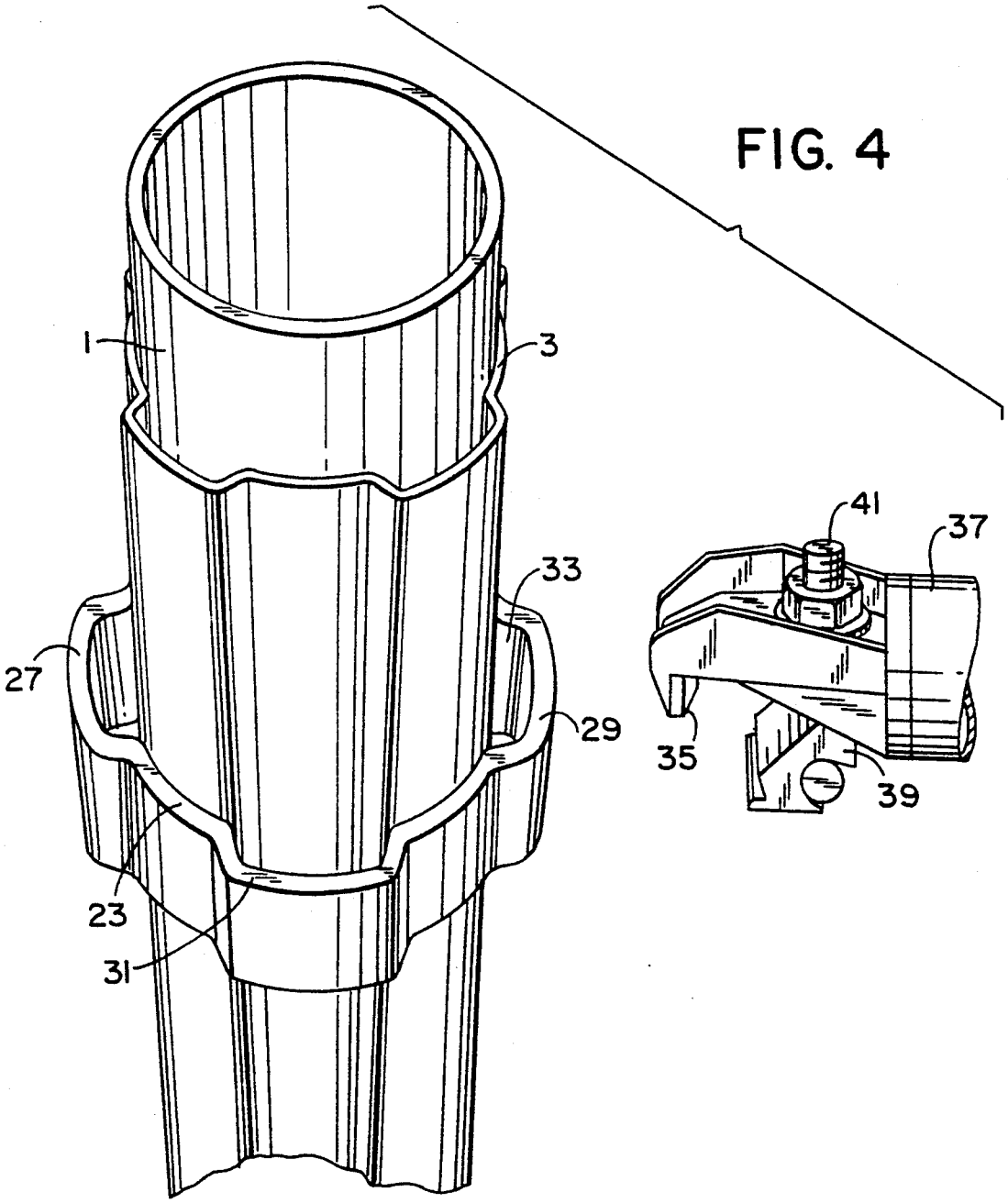
FIG. 4 shows a perspective view of the ring welded to the outer tube, the coupling element being near to the opening in which it is hooked in the ring.
Figure 5:
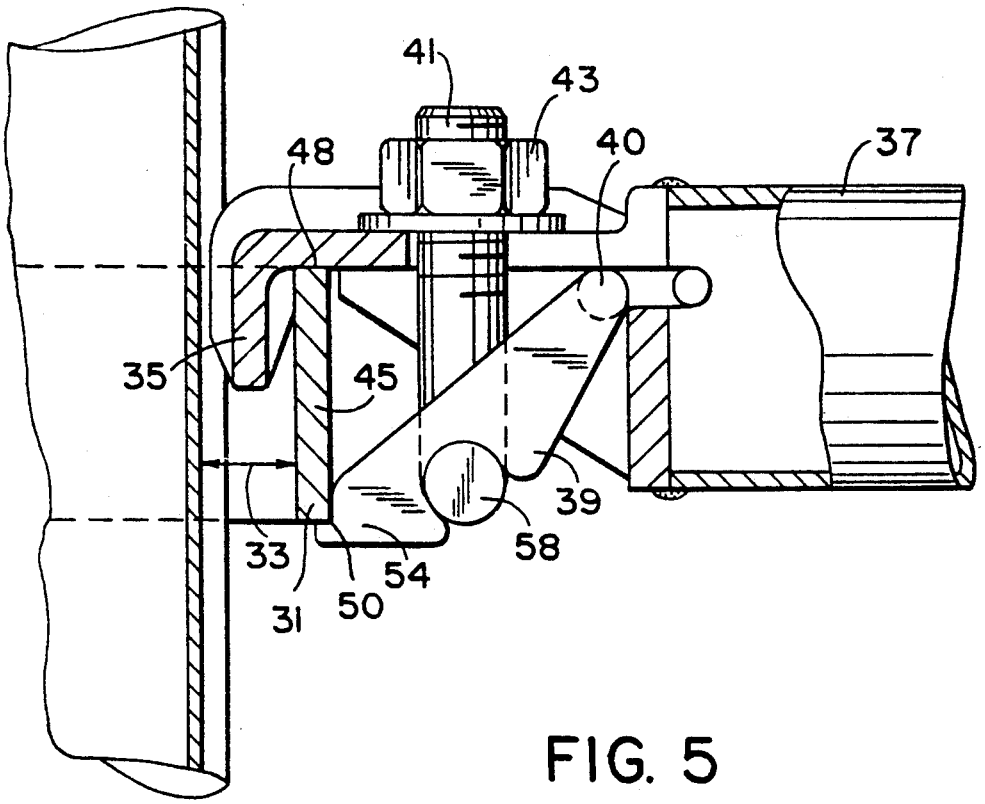
FIG. 5 shows partly in a sectional view the hooked nose of FIG. 4 in the position in which it is hooked in the ring and in a locked state along section V—V in FIG. 2.

For attaching horizontal girders or profiles to the outer tube 3, a construction according to a first solution may be utilized. A ring 23 is installed around the outer tube this ring comprising four widened parts 25, 27, 29 and 31. As shown in FIG. 3 the widened parts of the ring 23 coincide with the ridges 13 of the outer tube 3 and the cavity 33 formed by the ridges and the widened parts 25, 27, 29 and 31 is accessible to the hooked portion 35 of the horizontal girder 37 or coupling element (cf. FIGS. 4, 5, 6). The latter can protrude with its hooked nose part 35 into the cavity 33.

If so desired, this nose part 35 may also be locked in the ring 23. This may be realised effectively with the aid of the lever denoted 39 in FIG. 5, which hinges on the points 40, 42 and may be displaced by a displacing mechanism, in this case a bolt 41. By placing the spindle of the lever 39 at an angle of about 45 degrees relative to the longitudinal axis of the tube construction, there is achieved that only a minor adjustment of the nut 43 is necessary for permitting the lever 39 to sufficiently turn from a coupled vertical position (cf. FIG. 4) having the point referenced 40 as the pivoting point, to the ring 23, so that a clamping effect is obtained. By slightly turning the nut 43 is reverse direction, the locking effect can be cancelled and disassembling may be commenced.

Figure 6:
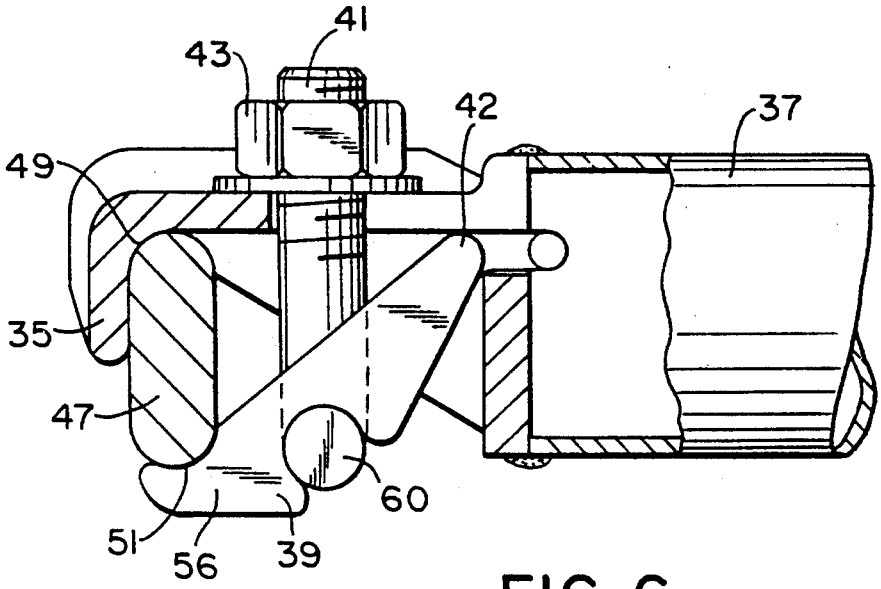
FIG. 6 shows a girder with a hooked end and a lock that applies to a section different from rectangular.

In the construction as shown in FIG. 6, the hooked end 35 of the coupling element, which end is to be clamped to the ring, does not exhibit a rectangular section, but a rounded section 47 and the form of the hook and of the lever having curves 49 and 51 respectively, is adjusted to the form of the section 47.

Figure 7:
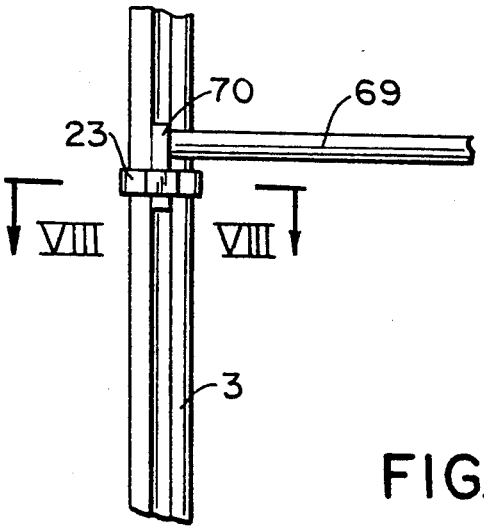
FIG. 7 gives a diagrammatic representation of a wedge-shaped coupling element attached to a coupling rod.
Figure 8:
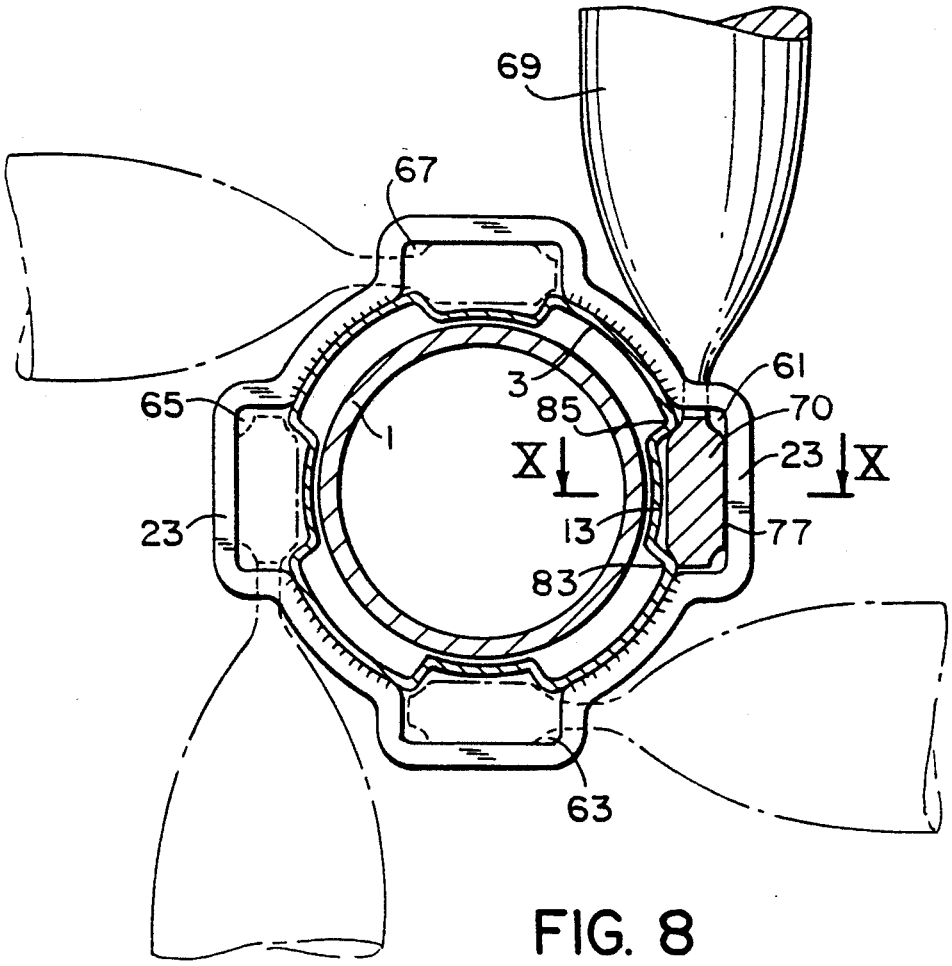
FIG. 8 is a diagrammatic cross-sectional view along VIII—VIII of FIG. 7.

In a second embodiment (FIG. 7, 8, 9) use is made of a ring 23 welded to the outer tube 3, so that four cavities 61, 63, 65 and 67 are formed. The coupling element is here arranged as a coupling rod 69 to each end of which a wedge-shaped element 71 is welded. This element 71, which may occur in fourfold, may be inserted into the cavity, e.g. 65, so that the coupling rod has a tangential position relative to the vertical tubes. This element 71 has two flanks 73 and 75 together forming a wedge. This element is dimensioned in such a way that the flank portion 73 rests against the inner wall 77 of the ring 23 and the portions of the flank section 75, protruding on both sides of the ring, that is to say, the portions 79 and 81, rest against the outer tube 3.

By driving the wedge-shaped element 71 into the cavity 65 in this embodiment, this element is clamped between the inner wall 77 of the ring 23 and outer tube 3. The wedge-shaped portion is then formed in such a way that the flank portions 79 and 81 rest against the ridge edges 83 and 85 and thus do not rest against the countersunk part 13. When the wedge-shaped element is thus inserted, this element is clamped between the two ridge edges 83 and 85 and the inside 77 of the ring 23, so that a fixed-angle joint is obtained between the vertical tube 3 and the coupling rod 69 in the plane of the coupling rod 69. Due to the interplay of forces in the joint, no continued effect of damage of the outer tube 3 can occur in the inner tube 1.

If so desired, a construction as shown in FIG. 10 may also be utilized. In this construction the ring is substituted by four brackets 91 welded to the outer tube 3, so that a cavity is realised in which a wedge-shaped part 93 may be clamped between the wall 95 and the outside wall of the rib 97.

We claim:

1. Supporting element for use in building constructions, comprising a metal inner tube (1) telescoping in a metal outer tube (3), characterized in that the outer tube (3) exhibits a substantially round cross section interrupted by inwardly extending ridges caused by deformation at least on three peripheral locations of said metal outer tube, these ridges having surfaces facing said inner tube and providing guides for the inner tube along said surfaces, wherein the ridges are formed running in an axial direction of the tube, and wherein the surfaces (15) of the ridges (13) guiding the inner tube, seen circumferentially around the inner tube, constitute about half the outer tube (3) periphery.

2. Supporting element as claimed in claim 1, characterized in that at least the outer tube (3) is formed of sheet steel.

3. Supporting element as claimed in claim 2, characterized in that the surfaces (15) of the ridges (13) guiding the inner tube, seen in tangential direction of the tube section, are formed by about half the outer tube (3) periphery.

4. Supporting element as claimed in claim 2, characterized in that the outer tube (3) accommodates at least one bracket (23) which comprises a widened portion (31) at the position of at least one ridge (13) of the outer tube, the cavity between the outside wall of the outer tube (3) and the bracket (31) being accessible to the hooked part (35) of a coupling element whose longitudinal axis is in essence perpendicular to that of the tube.

5. Supporting element as claimed in claim 4, characterized in that the bracket is a widened part of a ring (23) which ring is attached to the outer tube (3).

6. Supporting element for use in building constructions, comprising a metal inner tube (1) telescoping in a metal outer tube (3), characterized in that the outer tube (3) exhibits a substantially round cross section interrupted by inwardly extending ridges caused by deformation at least on three peripheral locations of said metal outer tube, these ridges having surfaces facing said inner tube and providing guides for the inner tube along said surfaces, and wherein at least the outer tube (3) is formed of sheet steel.

7. Supporting element as claimed in claim 6, characterized in that the surfaces (15) of the ridges (13) guiding the inner tube, seen in tangential direction of the tube section, are formed by about half the outer tube (3) periphery.

8. Supporting element as claimed in claim 6, characterized in that the outer tube (3) accommodates at least one bracket (23) which comprises a widened portion (31) at the position of at least one ridge (13) of the outer tube, the cavity between the outside wall of the outer tube (3) and the bracket (31) being accessible to the hooked part (35) of a coupling element whose longitudinal axis is in essence perpendicular to that of the tube.

9. Supporting element as claimed in claim 8, characterized in that the bracket is a widened part of a ring (23) which ring is attached to the outer tube (3).

10. Supporting element as claimed in claim 6, further comprising at least three substantially U-shaped members attached to respective ridges such that one arm of each U-shaped member is attached to one of said ridges and the other arm of each U-shaped member is attached to another of said ridges.

11. Supporting element as claimed in claim 10, wherein said U-shaped members are welded to said ridges.

12. Supporting element for use in building constructions, comprising a metal inner tube (1) telescoping in a metal outer tube (3), characterized in that the outer tube (3) exhibits a substantially round cross section interrupted by inwardly extending ridges caused by deformation at least on three peripheral locations of said metal outer tube, these ridges having surfaces facing said inner tube and providing guides for the inner tube along said surfaces, and wherein the outer tube (3) accommodates at least one bracket (23) which comprises a widened portion (31) at the position of at least one ridge (13) of the outer tube, a cavity being formed between an outside wall of the outer tube (3) and the bracket (31) and being accessible to a hooked part (35) of a coupling element whose longitudinal axis is in essence perpendicular to that of the outer tube (3).

13. Supporting element as claimed in claim 12, characterized in that the bracket is a widened part of a ring (23) which ring is attached to the outer tube (3).

14. In conjunction with said supporting element according to claim 13, a coupling element, including a device for locking said coupling element, said coupling element having a hooked end (35) hooked over a wall portion (45,47) of the ring of the supporting element wherein the coupling element is clamped to the wall portion of the ring by means of said clamping device (39) applied to the wall portion at a location (50, 51) diametral relative to the butting location (48,49) of the hooked end (35) of the coupling element.

15. The combination as claimed in claim 14, characterized in that the clamping device is formed by a lever (39) of which one end (at 40,42) is hinged to a fixed point of the hooked end (35), the other end (54,56) applies to the wall portion (45,47) is obtained by means of a displacing element (41) applied to a point (58,60) positioned between the two ends of the lever.

16. The combination as claimed in claim 15, characterized in that the lever forms an angle of about 45 degrees to the central axis of the tube.

17. The combination as claimed in claim 15, characterized in that the displacing element is formed by a bolt (41) hinged to the lever (39).

18. In conjunction with the supporting element of claim 13, a coupling element, including a device for locking said coupling element, said ring (23) having a widened portion (31), and said coupling element having a hooked end in a cavity between the outer tube (3) and said widened portion (31) of said ring (23) wherein the coupling element comprises a hooked wedge-shaped portion (70) resting with the wedge flank portion located between the thicker wedge portion (71) and the thinner wedge portion (72) of the one wedge flank (73) against the inside (77) of the ring (23) and resting with the portion (79–81) of the other wedge flank (75) which are located above and below the ring (23) against the outside of the outer tube (3).

19. The combination as claimed in claim 18, characterized in that the sections of the wedge flank portions (79 and 81) facing the tube (3) rest against the ridge edges (83 and 85) on both sides of the countersunk ridge portion (13), while leaving the countersunk ridge portion of the outer tube (3) free.

* * * * *